US009261089B2

(12) United States Patent
Chang

(10) Patent No.: US 9,261,089 B2
(45) Date of Patent: Feb. 16, 2016

(54) PUMP AND CHECK RING THEREOF

(71) Applicant: DINO TECHNOLOGY CO., LTD., Taoyuan County (TW)

(72) Inventor: Chin-Chou Chang, Taoyuan County (TW)

(73) Assignee: DINO TECHNOLOGY CO., LTD., Taoyuan County (TW)

( * ) Notice: Subject to any disclaimer, the term of this patent is extended or adjusted under 35 U.S.C. 154(b) by 393 days.

(21) Appl. No.: 13/787,459

(22) Filed: Mar. 6, 2013

(65) Prior Publication Data

US 2014/0255220 A1 Sep. 11, 2014

(51) Int. Cl.

| | |
|---|---|
| ***F04B 53/00*** | (2006.01) |
| ***F04B 43/02*** | (2006.01) |
| ***F04B 43/06*** | (2006.01) |
| ***F04B 43/08*** | (2006.01) |

(52) U.S. Cl.

CPC ..... *F04B 43/02* (2013.01); *F04B 43/06* (2013.01); *F04B 43/084* (2013.01)

(58) Field of Classification Search

CPC ..... F04B 43/02; F04B 43/04; F04B 43/06; F04B 43/076; F16C 29/12; F16C 33/72; F16J 15/16; F16J 15/545; F16J 15/56

USPC ..... 277/346, 381, 469, 559, 633–636; 417/395

See application file for complete search history.

(56) References Cited

U.S. PATENT DOCUMENTS

| | | | | |
|---|---|---|---|---|
| 4,357,056 | A * | 11/1982 | Olschewski | F16C 29/0688 384/43 |
| 5,927,954 | A * | 7/1999 | Kennedy et al. | 417/397 |
| 6,874,997 | B2 * | 4/2005 | Watanabe | F04B 9/135 417/393 |
| 6,880,830 | B2 * | 4/2005 | Olsson | F16C 33/72 277/536 |
| 7,828,300 | B2 * | 11/2010 | Munekata | F16J 15/3232 277/436 |
| 8,672,645 | B2 * | 3/2014 | Lin | F04B 43/026 137/625.69 |
| 2004/0058828 | A1 * | 3/2004 | Iwata | C10M 111/04 508/104 |

* cited by examiner

*Primary Examiner* — Nathan J Newhouse
*Assistant Examiner* — Connor Tremarche
(74) *Attorney, Agent, or Firm* — Guice Patents PLLC

(57) ABSTRACT

The present invention relates to a pump, which comprises a pump body, a pair of check rings and a pneumatic control valve. When the pneumatic control valve is operated, a main shaft in the pump body is enabled to reciprocally move in a shaft hole, thereby enabling two diaphragms to be stretched and compressed at the same time for performing the compressing and the sucking stroke for the liquid; when subject to the hydraulic pressure, an arc-shaped convex ring of each of the check rings is deformed, and a contract ring is contracted for enclosing the main shaft thereby forming a liquid checking effect; when each of the check rings is not subject to the hydraulic pressure or the air pressure, the arc-shaped convex ring is not deformed thereby forming a slit between the contract ring and the main shaft.

5 Claims, 11 Drawing Sheets

PUMP AND CHECK RING THEREOF

BACKGROUND OF THE INVENTION

1. Field of the Invention

The present invention relates to a pump, especially to a pump installed with at least a check ring, wherein the check ring is capable of enclosing a main shaft for providing a liquid checking effect or capable of releasing the main shaft for forming a slit. Furthermore, the present invention provides a check ring used in a pump.

2. Description of Related Art

A pump is device for transporting liquid, air or special fluid medium, i.e. a machinery acting on fluid. Take a semiconductor wafer manufacturing factory for example, when a wafer is desired to be processed with cleaning and etching, a strong acid or string alkaline liquid is required, and during the process of a conventional kinetic pump being used for transporting the strong acid or strong alkaline liquid, the securing position of the impeller of the kinetic pump may have damages such as cavitation or acid corrosion thereby causing the liquid to be contaminated. As such, skilled people in the art have developed a pneumatic dual-diaphragm pump integrally made of an acid and alkaline resistant material, e.g. polytetrafluoroethylene (PTFE), which is trademarked as Teflon, thereby preventing the pump from being damaged by the strong acid or strong alkaline liquid.

The mentioned pneumatic dual-diaphragm pump is a volume pump, in which a pump body is connected with a pressure control valve, the pneumatic dual-diaphragm pump is to utilize the pressure control valve to drive a reciprocally-moving main shaft installed in the pump body, and the main shaft is received in a shaft hole, and two ends of the main shaft are respectively installed with a full-cover diaphragm, each diaphragm divides two pump chambers into an individual air chamber and an individual liquid chamber. When high pressure air is introduced into the pump, the pressure control valve is driven to act for allowing the main shaft to reciprocally move, thereby causing the two diaphragms to be deformed at the same time for changing the volume of each liquid chamber, so the liquid is sucked in or pumped out due to the pressure difference.

For providing a sealing effect to the pump chambers at two ends of the main shaft, a seal ring is respectively installed at two sides of the shaft hole, the main shaft is sleeved with the two seal rings and reciprocally moved. Wherein, the main shaft and the seal rings are made of an acid and alkaline resistant material, e.g. Teflon. When the liquid transportation is finished and the air source is not yet closed, the pressure control valve still drives the main shaft in the pump body to reciprocally move, so the main shaft is forced to directly and repeatedly rub against the seal rings without the heat dissipating and lubricating effects provided by the liquid, thereby causing the two components being heated and expanded due to heat, thus dead latch is formed. At this moment, if no proper action is taken, the main shaft and the seal rings may be melted due to the high temperature, thereby damaging the main shaft and the seal ring.

SUMMARY OF THE INVENTION

One primary objective of the present invention is to provide a pump, especially a pneumatic dual-diaphragm pump, in which two check rings allowing a main shaft in a pump body to be sleeved are specially designed, so each check ring of the check rings is enabled to be contracted and deformed when subject to the hydraulic pressure thereby enclosing the main shaft for forming a liquid checking effect; and when not subject to the hydraulic pressure or the air pressure, each of the check rings is not contracted nor deformed thereby forming a slit or space between the check ring and the main shaft.

For achieving the aforesaid objective, one technical solution of the present invention is to provide a pump, which comprises:

a pump body, pump chambers at two sides thereof are respectively formed with a shaft hole allowing a main shaft to pass, a liquid outlet passage having a liquid outlet port, a liquid inlet passage having a liquid inlet port, wherein two sides of the shaft hole are respectively formed with an engaging slot, the locations where the liquid outlet and the liquid inlet passage being adjacently connected to the two pump chambers are respectively formed with a pair of check valves, two ends of the main shaft are respectively connected with a diaphragm thereby dividing each of the pump chambers into an air chamber and a liquid chamber, and two end covers are respectively combined at outer sides of the two pump chambers thereby securing the diaphragm between each of the end covers and the pump body, and the two end covers are respectively formed with a first and a second air inlet port and a first and a second main air passage port communicating with the air chambers, and a switch rod is respectively installed in the first and the second air inlet port;

a pair of check rings allowing the main shaft to pass, and the interior thereof is formed with a combination part for being correspondingly engaged in the engaging slots at two sides of the shaft hole, and the bottom periphery of an arc-shaped convex ring formed at the outer side of the check ring is axially extended with a contract ring capable of being contracted and deformed; and a pneumatic control valve respectively formed with a first and a second air guide pipe and a first and a second air inlet pipe respectively communicating with the first and the second main air passage port and the first and the second air inlet port;

through the action of the pneumatic control valve, the main shaft is enabled to reciprocally move in the shaft hole, thereby enabling the two diaphragms to be stretched and compressed at the same time for performing the compressing and the sucking stroke to the liquid; when subject to the hydraulic pressure, the arc-shaped convex ring of each of the check rings is deformed, and the contract ring is contracted for enclosing the main shaft thereby forming a liquid checking effect; when each of the check rings is not subject to the hydraulic pressure or the air pressure, the arc-shaped convex ring is not deformed thereby forming a slit between the contract ring and the main shaft.

Another objective of the present invention is to provide a check ring used in a pump, which is enabled to be contracted and deformed when subject to the hydraulic pressure, and the check ring is not contracted nor deformed when not subject to the hydraulic pressure or the air pressure.

For achieving the aforesaid objective, one technical solution of the present invention is to provide a check ring used in a pump, the interior thereof is formed with a combination part, the bottom periphery of an arc-shaped convex ring formed at the outer side thereof is axially extended with a contract ring capable of being contracted and deformed; the arc-shaped convex ring of the check ring is deformed when subject to the hydraulic pressure thereby causing the contract ring to be contracted; when the check ring is not subject to the hydraulic pressure or the air pressure, the arc-shaped convex ring and the contract ring are not deformed nor contracted.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
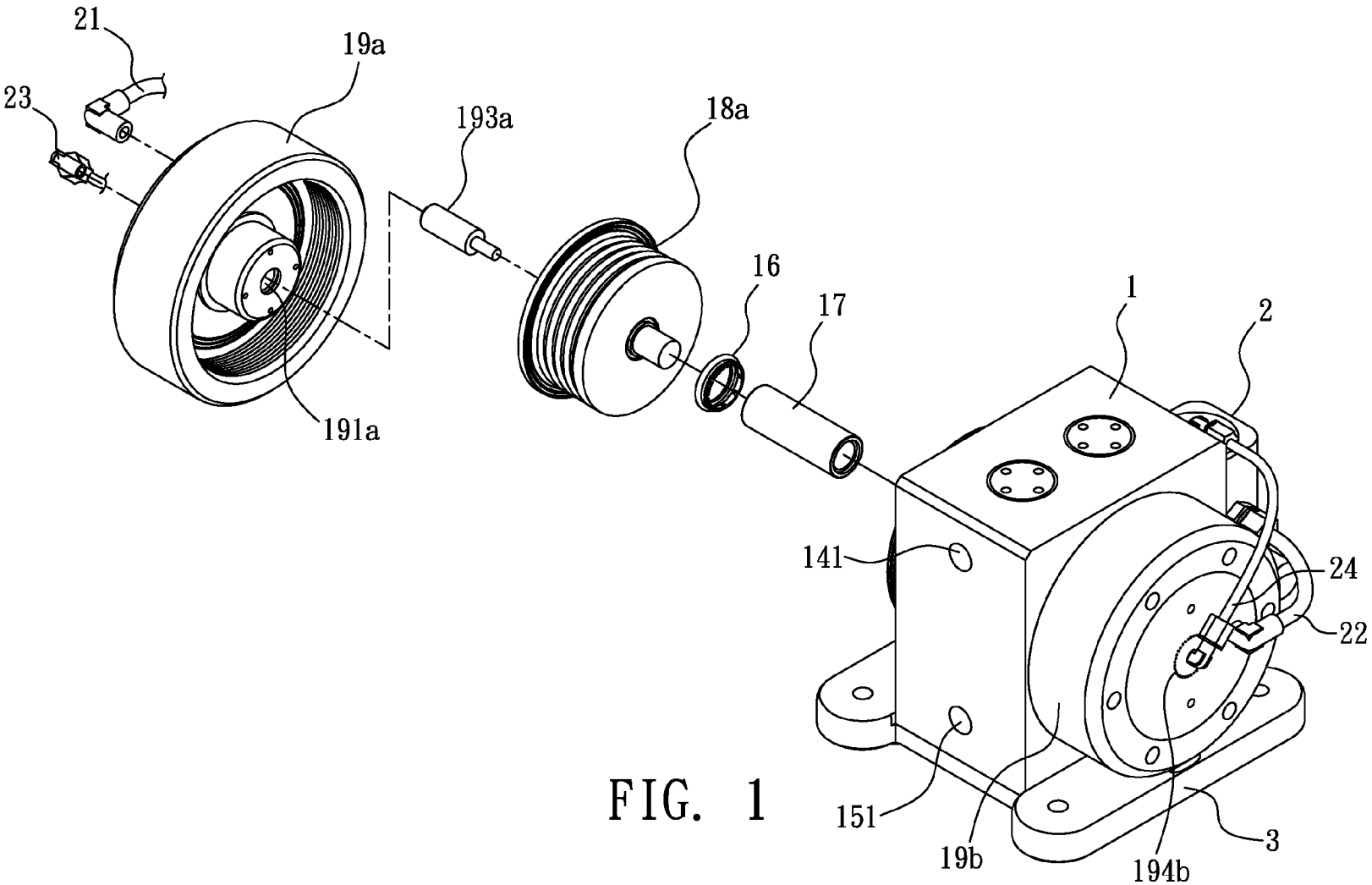
FIG. 1 is a perspective exploded view illustrating the pump according to the present invention.
Figure 2:
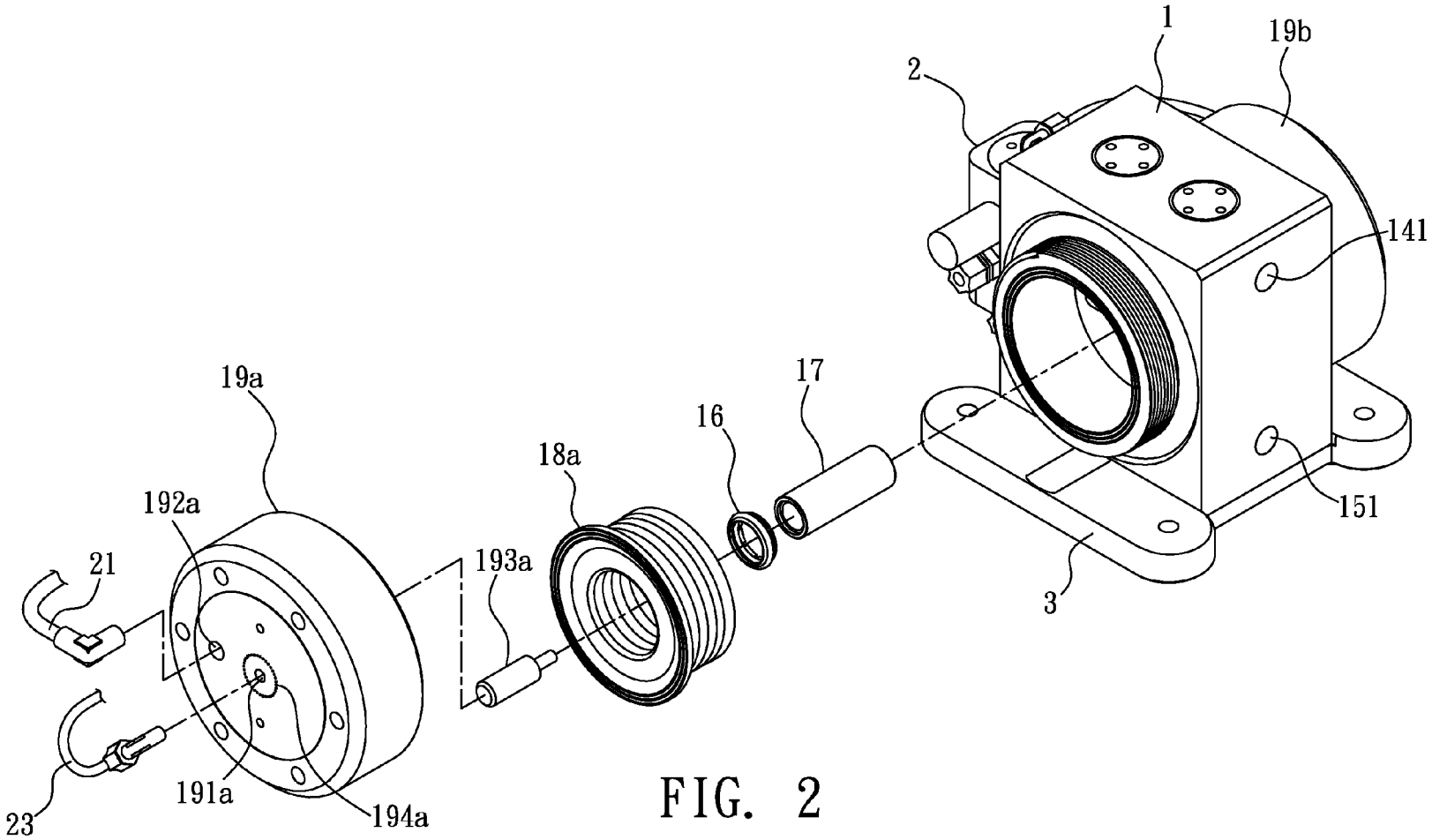
FIG. 2 is another perspective exploded view illustrating the pump being viewed from another angle according to the present invention.
Figure 3:
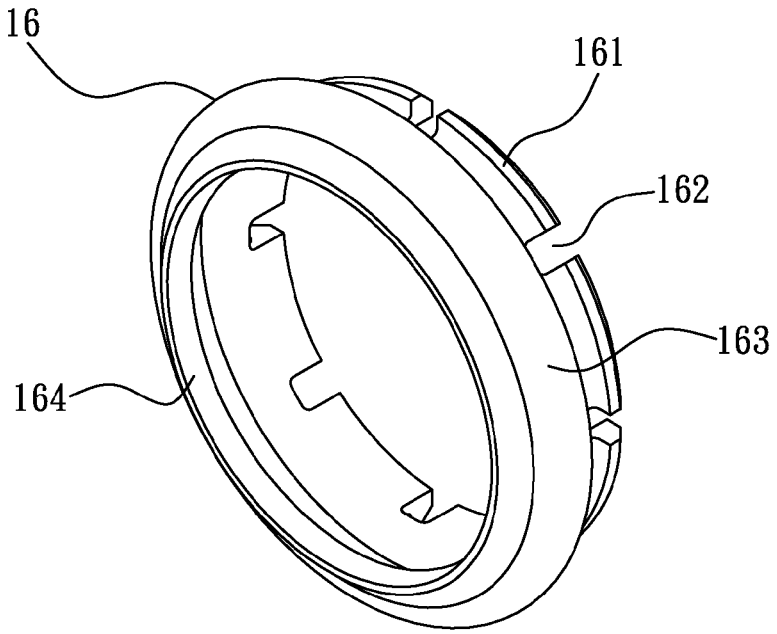
FIG. 3 is a perspective view illustrating the check ring according to the present invention.
Figure 4:
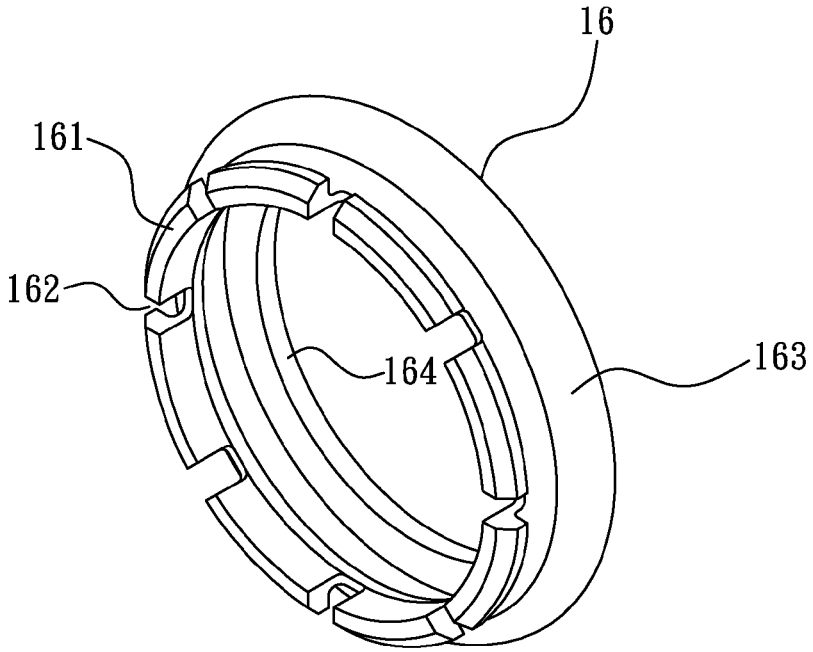
FIG. 4 is a perspective view illustrating the check ring being viewed from another angle according to the present invention.
Figure 5:
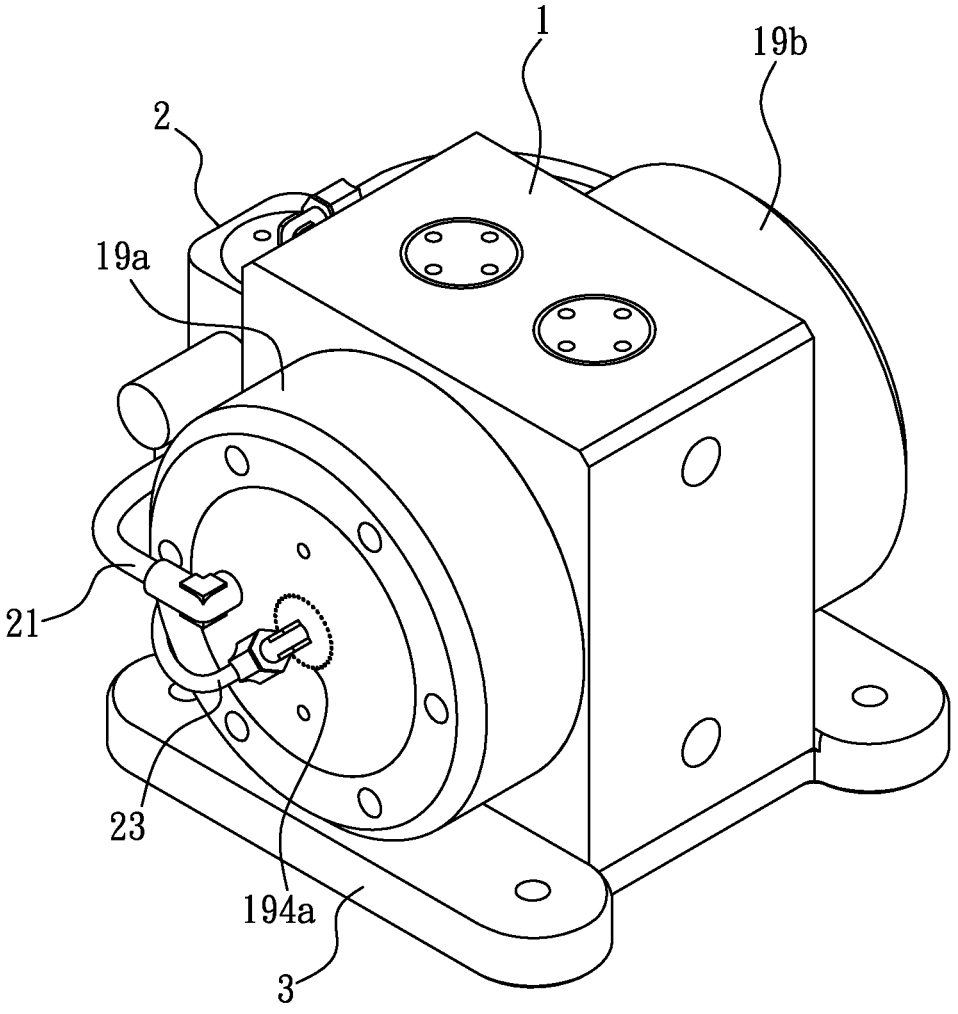
FIG. 5 is a perspective view illustrating the assembly of the pump according to the present invention.
Figure 6A:
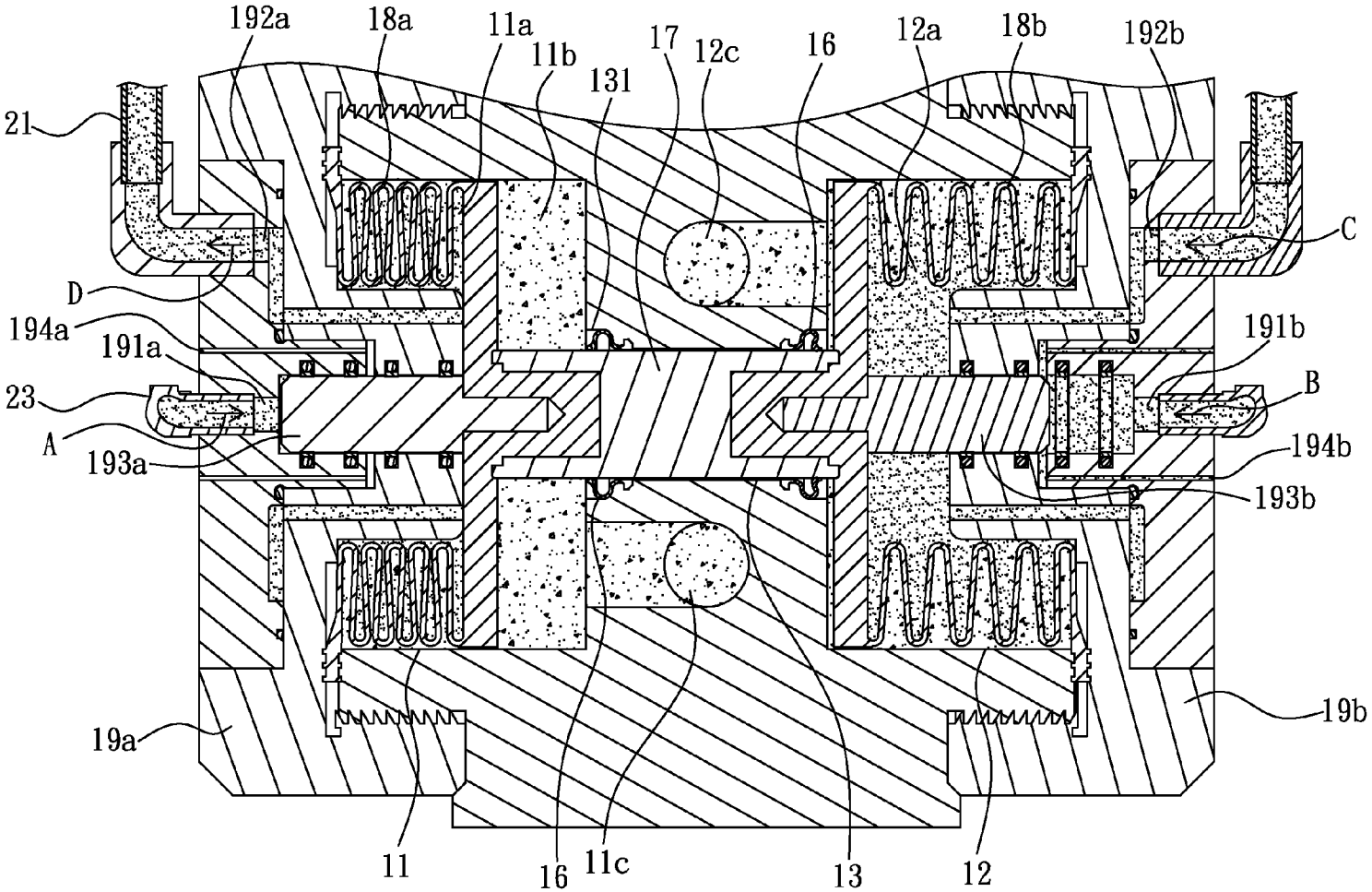
FIG. 6*a* is a cross sectional view illustrating the main shaft of the pump being at a first position according to the present invention.
Figure 6B:
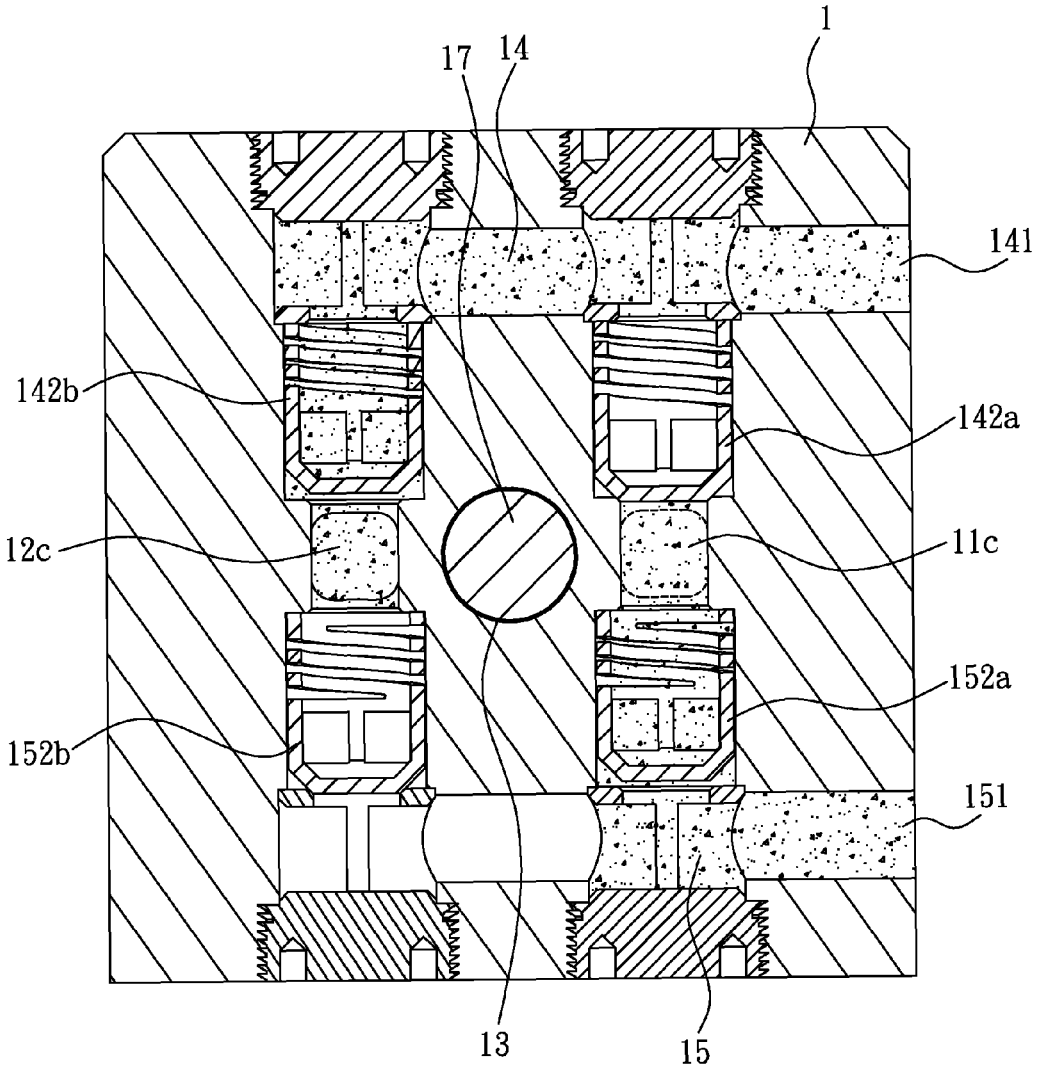
FIG. 6*b* is another cross sectional view illustrating the main shaft of the pump being at the first position according to the present invention.
Figure 6C:
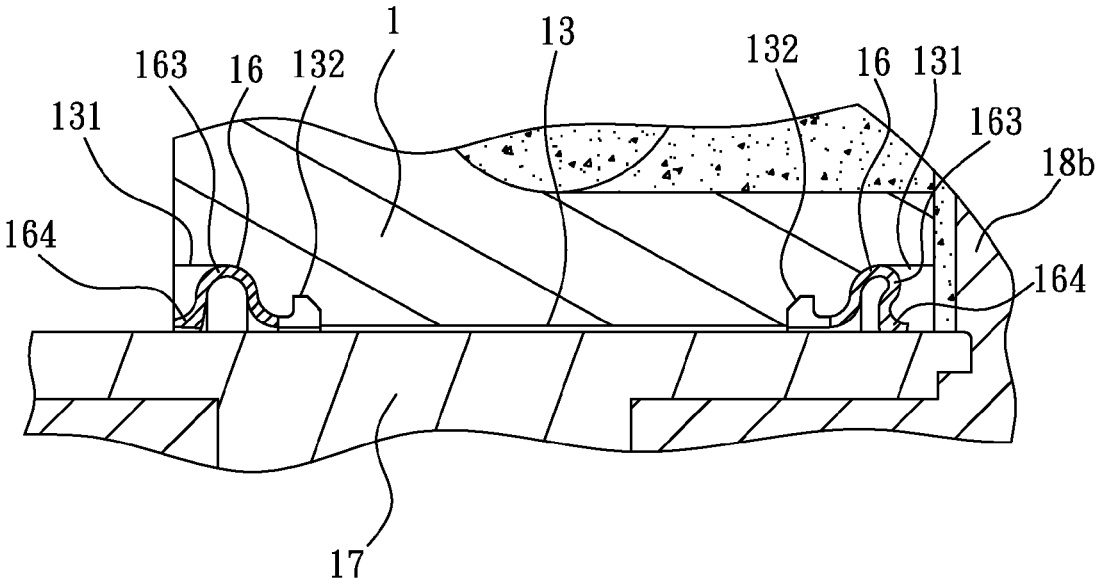
FIG. 6*c* is a cross sectional and partially enlarged view illustrating the two check rings while the main shaft being at the first position according to the present invention.
Figure 7A:
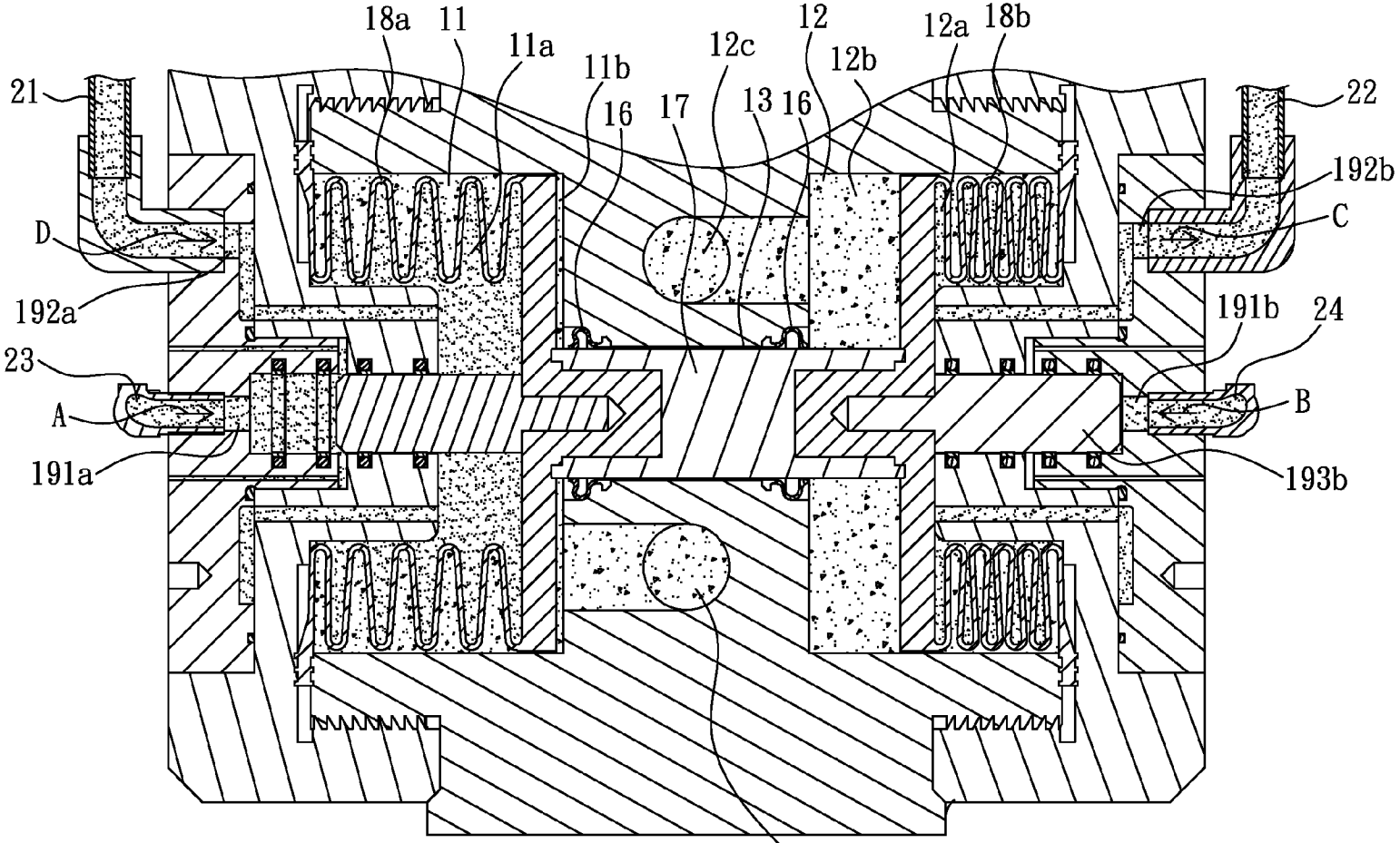
FIG. 7*a* is a cross sectional view illustrating the main shaft of the pump being at a second position according to the present invention.
Figure 7B:
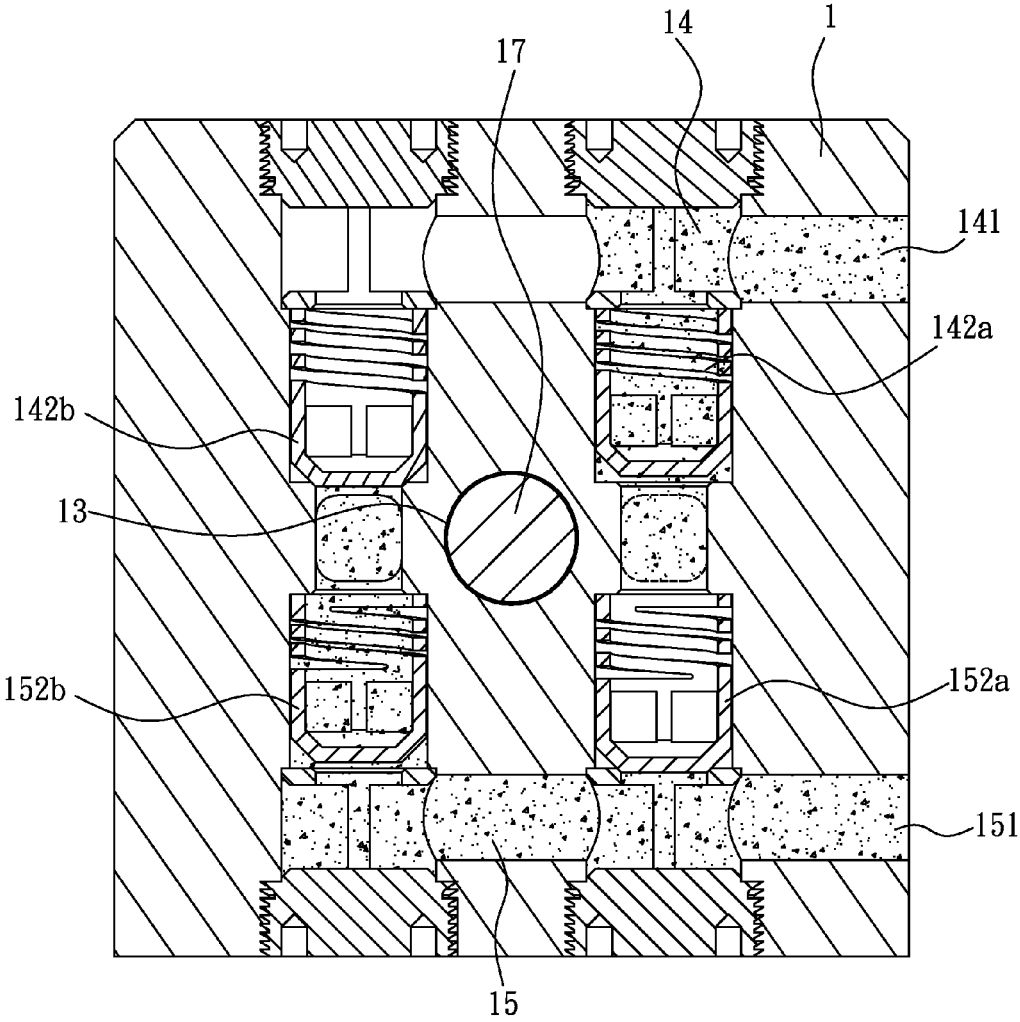
FIG. 7*b* is another cross sectional view illustrating the main shaft of the pump being at the second position according to the present invention.
Figure 7C:
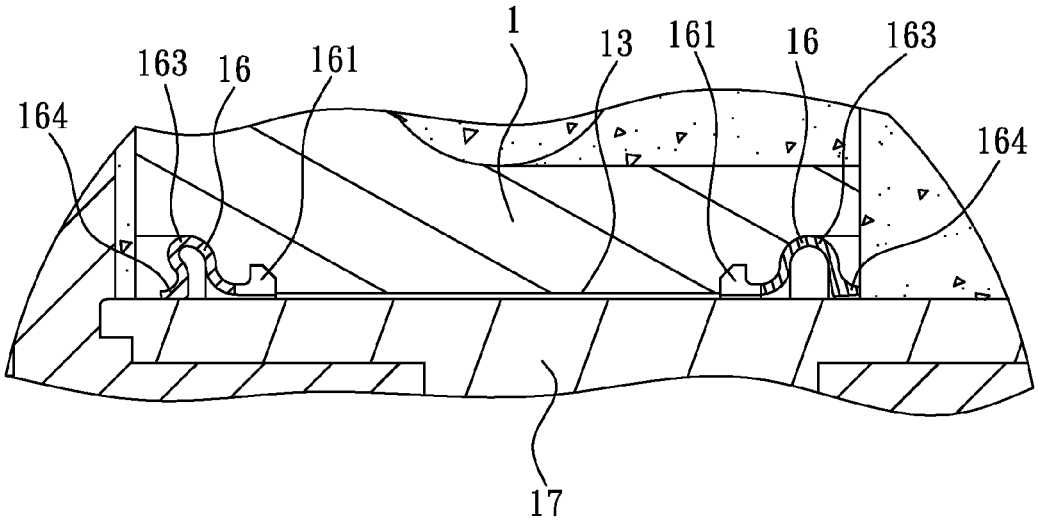
FIG. 7*c* is a cross sectional and partially enlarged view illustrating the two check rings while the main shaft being at the second position according to the present invention.
Figure 8:
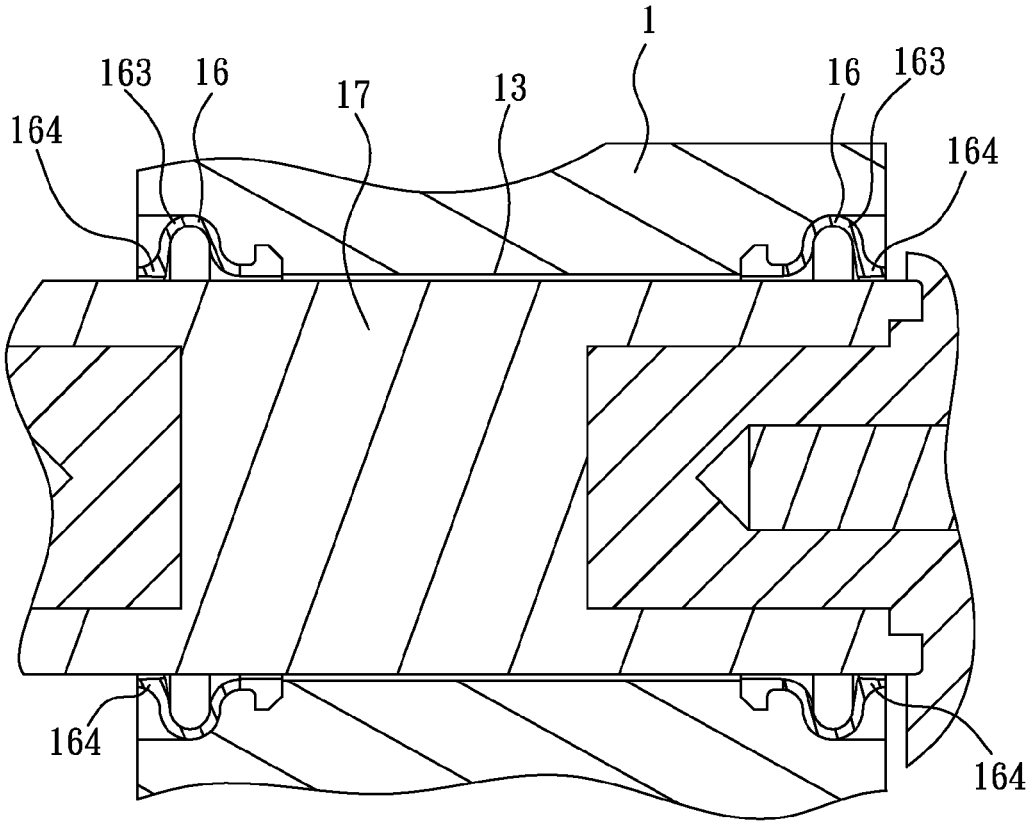
FIG. 8 is a cross sectional and partially enlarged view illustrating the two check rings while the main shaft being subject to the air pressure according to the present invention.

Referring from FIG. 1 to FIG. 8, wherein FIG. 1 is a perspective exploded view illustrating the pump according to the present invention; FIG. 2 is another perspective exploded view illustrating the pump being viewed from another angle according to the present invention; FIG. 3 is a perspective view illustrating the check ring according to the present invention; FIG. 4 is a perspective view illustrating the check ring being viewed from another angle according to the present invention; FIG. 5 is a perspective view illustrating the assembly of the pump according to the present invention; FIG. 6A is a cross sectional view illustrating the main shaft of the pump being at a first position according to the present invention; FIG. 6B is another cross sectional view illustrating the main shaft of the pump being at the first position according to the present invention; FIG. 6C is a cross sectional and partially enlarged view illustrating the two check rings while the main shaft being at the first position according to the present invention; FIG. 7A is a cross sectional view illustrating the main shaft of the pump being at a second position according to the present invention; FIG. 7B is another cross sectional view illustrating the main shaft of the pump being at the second position according to the present invention; FIG. 7C is a cross sectional and partially enlarged view illustrating the two check rings while the main shaft being at the second position according to the present invention; and FIG. 8 is a cross sectional and partially enlarged view illustrating the two check rings while the main shaft being subject to the air pressure according to the present invention.

As shown from FIG. 1 to FIG. 6*c*, the pump provided by the present invention is e.g. but not limited to a pneumatic dual-diaphragm pump, the pump includes a pump body 1 and a pneumatic control valve 2.

Referring from FIG. 1 to FIG. 4 and FIG. 6*a* and FIG. 6*b*, the pump body 1 is preferably made of an acid and alkaline resistant material, e.g. polytetrafluoroethylene (PTFE) or PTFE added with PFA (tetrafluoroethylene-perfluoroalkyl vinyl ether copolymer). A first pump chamber 11 and a second pump chamber 12 at two sides of the pump body 1 are respectively formed with a shaft hole 13, a liquid outlet passage 14 and a liquid inlet passage 15 (shown in FIG. 6*b*). Wherein, two sides of the shaft hole 13 are formed with a pair of engaging slots 131 allowing two check rings 16 to be engaged and installed, and the two check rings 16 allow a main shaft 17 to pass, and two ends of the main shaft 17 are respectively installed with a diaphragm 18*a*, 18*b*. The liquid outlet and the liquid inlet passage 14, 15 are respectively formed with a liquid outlet port 141 and a liquid inlet port 151 at the outer side of the pump body 1, as shown in FIG. 6*a* and FIG. 6*b*, the first and the second pump chamber 11, 12 are respectively in communication with the liquid outlet and the liquid inlet passage 14, 15 through a first and a second guide port 11*c*, 12*c*, and the interior of the liquid outlet passage 14 and the interior of the liquid inlet passage 15 are respectively formed with a pair of check valves 142*a*, 142*b* and 152*a*, 152*b* correspondingly arranged in parallel.

As shown in FIG. 3 and FIG. 4, the check rings 16 and the main shaft 17 are made of an acid and alkaline resistant material, e.g. polytetrafluornethylene (PTFE), the interior of each of the check rings 16 is formed with a combination part 161, e.g. plural annularly-arranged elastic hooks 162, the hooks 162 are buckled in buckle slots 132 formed at the inner sides of the engaging slots 131 and communicating with each other, thereby enabling each of the check rings 16 to be accommodated and positioned in the corresponding engaging slot 131; the bottom periphery of an arc-shaped convex ring 163 formed at the outer side of the check ring 16 is axially extended with a contract ring 164 capable of being contracted and deformed.

Two sides of the pump body 1 are respectively combined with an end cover 19*a*, 19*b*, and two sides of the pump body 1 are respectively fastened with a diaphragm 18*a*, 18*b*, so with the installation of each of the diaphragms 18*a*, 18*b*, the first and the second pump chamber 11, 12 are respectively divided into a first and a second air chamber 11*a*, 12*a*, and a first and a second liquid chamber 11*b*, 12*b*. The two end covers 19*a*, 19*b* are respectively formed with a first and a second air inlet port 191*a*, 191*b* and a first and a second main air passage port 192*a*, 192*b* which are respectively in communication with the first and the second air chamber 11*a*, 12*a*, wherein the interior of the first and the second air inlet port 191*a*, 191*b* are respectively installed with a first and a second switch rod 193*a*, 193*b*.

Referring to FIG. 1, FIG. 2 and FIG. 5, the pneumatic control valve 2 is installed at the outer side of the pump body 1, and a first and a second air guide pipe 21, 22 and a first and a second air inlet pipe 23, 24 of the pneumatic control valve 2 are respectively connected to the first and the second main air passage port 192*a*, 192*b* and the first and the second air inlet port 191*a*, 191*b*, then the pump body 1 is installed on a base 3.

Referring from FIG. 6*a* to FIG. 6*c*, when air is introduced into the pneumatic control valve 2, the air is compressed and passes the second air guide pipe 22, and passes the second main air passage port 192*b* along an arrow C direction, then enters the second air chamber 12*a* of the second pump chamber 12. At this moment, the diaphragm 18*b* at the right side is compressed for being leftwardly stretched thereby forming a compressing stroke, and the main shaft 17 is leftwardly moved to a first position, the arc-shaped convex ring 163 of the check ring 16 at the right side of the shaft hole 13 is subject to the hydraulic pressure thereby causing the contract ring 164 to be contracted and deformed for enclosing the main shaft 17, so a liquid checking effect is provided (as shown in FIG. 6*c*); accordingly, the liquid in the second liquid chamber 12*b* is compressed and passes the second guide port 12*c* and the opened check valve 142*b* of the liquid outlet passage 14 (meanwhile the another check valve 142*a* is in the closed state), and is discharged to the exterior from the liquid outlet port 141. Because the main shaft 17 is connected between the two diaphragms 18*a*, 18*b*, when the diaphragm 18*b* at one side (the right side) is leftwardly pushed for compressing the liquid, the main shaft 17 is displaced thereby causing the diaphragm 18*a* at the other side (the left side) to be leftwardly contracted for forming an opposite liquid sucking stroke; so through the first guide port 11*c*, liquid is enabled to be sucked by the first liquid chamber 11*b* from the liquid inlet port 151 of the liquid inlet passage 15, and to pass the opened check valve 152*a* (meanwhile the other check valve 152*b* is in the closed state), thereby allowing the first liquid chamber 11*b* to be filled with liquid. At this moment, the arc-shaped convex ring 163 of the check ring 16 at the left side of the shaft hole 13 is not subject to the hydraulic pressure, so the contract ring 164 releases the main shaft 17 thereby forming a slit (as shown in FIG. 6*c*).

During the mentioned compressing and sucking stroke, the pneumatic control valve 2 enables a part of the compressed air to respectively enter the first and the second air inlet pipe 23, 24, then enter the first and the second air inlet port 191*a*, 191*b* respectively along an arrow A direction and an arrow B direction, so the second switch rod 193*b* is leftwardly moved along with the diaphragm 18*b*, and the second air inlet port 191*b* is opened, so the compressed air introduced from the second air inlet pipe 24 is discharged from plural annularly-arranged air outlet ports 194*b* formed on the end cover 19*b*.

At this moment, the diaphragm 18*a* at the left side and the first switch rod 193*a* are leftwardly moved by the main shaft 17, thereby sealing the first air inlet port 191*a*, and the compressed air in the first air inlet pipe 23 is blocked at the first air inlet port 191*a* towards the arrow A direction, and the air inside the first air chamber 11*a* is compressed by the diaphragm 18*a* at the left side and discharged from the first main air passage port 192*a*, and passed the first air guide pipe 21 along an arrow D direction and discharged to the exterior through the pneumatic control valve 2. As such, an instantaneous pressure drop is generated between the pneumatic control valve 2 and the second air inlet port 191*b*, so the pressure is smaller than the pressure between the pneumatic control valve 2 to the first air inlet port 191*a*, thereby changing the output direction of the compressed air in the pneumatic control valve 2 to the first air guide pipe 21.

Referring to FIG. 7*a* and FIG. 7*b*, the compressed air in the pneumatic control valve 2 enters the first air guide pipe 21, and passes the first main air passage port 192*a* along the arrow D direction, thereby entering the first air chamber 11*a* of the first pump chamber 11. At this moment, the diaphragm 18*a* at the left side is compressed for being rightwardly stretched thereby forming the compressing stroke, and the main shaft 17 is rightwardly moved to a second position, the arc-shaped convex ring 163 of the check ring 16 at the left side of the shaft hole 13 is subject to the hydraulic pressure thereby causing the contract ring 164 to be contracted and deformed for enclosing the main shaft 17, so the liquid checking effect is provided (as shown in FIG. 7*c*); accordingly, the liquid in the first liquid chamber 11*b* is compressed and passes the first guide port 11*c* and the opened check valve 142*a* of the liquid outlet passage 14 (meanwhile the another check valve 142*b* is in the closed state), and discharged to the exterior from the liquid outlet port 141. The diaphragm 18*b* at the other side (the right side) is rightwardly contracted for forming the opposite liquid sucking stroke, through the second guide port 12*c*, liquid is enabled to be sucked by the second liquid chamber 12*b* from the liquid inlet port 151 of the liquid inlet passage 15, and passes the opened check valve 152*b* (meanwhile the other check valve 152*a* is in the closed state), thereby allowing the second liquid chamber 12*b* to be filled with liquid. At this moment, the arc-shaped convex ring 163 of the check ring 16 at the right side of the shaft hole 13 is not subject to the hydraulic pressure, so the contract ring 164 releases the main shaft 17 thereby forming a slit (as shown in FIG. 7*c*).

During the mentioned compressing and sucking stroke, the pneumatic control valve 2 enables a part of the compressed air to respectively enter the first and the second air inlet pipe 23, 24, then enter the first and the second air inlet port 191*a*, 191*b* respectively along the arrow A direction and the arrow B direction, so the first switch rod 193*a* is rightwardly moved along with the diaphragm 18*a*, and the first air inlet port 191*a* is opened, so the compressed air introduced from the first air inlet pipe 23 is discharged from plural annularly-arranged air outlet ports 194*a* formed on the end cover 19*a*.

At this moment, the diaphragm 18*b* at the right side and the second switch rod 193*b* are rightwardly moved by the main shaft 17, thereby sealing the second air inlet port 191*b*, and the compressed air in the second air inlet pipe 24 is blocked at the second air inlet port 191*b* towards the arrow B direction, and the air inside the second air chamber 12*a* is compressed by the diaphragm 18*b* at the right side and discharged from the second main air passage port 192*b*, and passed the second air guide pipe 22 along the arrow C direction and discharged to the exterior through the pneumatic control valve 2. As such, an instantaneous pressure drop is generated between the pneumatic control valve 2 and the first air inlet port 191*a*, so the pressure is smaller than the pressure between the pneumatic control valve 2 to the second air inlet port 191*b*, thereby changing the output direction of the compressed air in the pneumatic control valve 2 to the second air guide pipe 22. As such, through the pump body 1 and the pneumatic control valve 2 repeatedly performing the mentioned actions, the compressing and sucking action is enabled to be alternatively performed in the two pump chambers 11, 12 for achieving the operation of transporting liquid by pump.

When the liquid transportation is finished, the pump body 1 and the pneumatic control valve 2 still repeatedly perform the mentioned actions, thereby enabling the diaphragms 18*a*, 18*b* at the two pump chambers 11, 12 to be respectively stretched or compressed, the main shaft 17 is therefore driven to reciprocally move in the shaft hole 13. Referring to FIG. 8, when the liquid transportation is finished, the arc-shaped convex rings 163 of the two check rings 16 are only subject to the air pressure; however, the air pressure is not sufficient enough to force the contract ring 164 to be contracted and deformed, so a slit is formed between the main shaft 17 and the contract ring 164 of each of the check rings 16, thereby avoiding generating friction with the main shaft 17, so the temperature of the main shaft 17 is prevented from raising, thus the service life of the main shaft 17 and the check ring 16 is prolonged.

As what has been disclosed above, the present invention has following advantages: a pair of check rings are correspondingly installed at two sides of the shaft hole formed in the pump body, so the arc-shaped convex ring of each of the check rings is enabled to be deformed due to the hydraulic pressure, thereby forcing the contract ring to be contracted for enclosing the main shaft, thereby forming the liquid checking effect; when each of the check rings is not subject to the liquid pressure or the air pressure, the arc-shaped convex ring is not deformed, and a slit is formed between the contract ring and the main shaft, so friction is prevented from being generated between the contract ring and the main shaft, thereby preventing the temperature of the main shaft from raising, the service life of the main shaft and the check ring is therefore prolonged. Accordingly, the present invention is novel and practice in use comparing to the prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A pump, comprising:

a pump body, pump chambers at two sides thereof being respectively formed with a shaft hole allowing a main shaft to pass, a liquid outlet passage having a liquid outlet port, a liquid inlet passage having a liquid inlet port, wherein two sides of said shaft hole being respectively formed with an engaging slot, the locations where said liquid outlet and said liquid inlet passage being adjacently connected to said two pump chambers being respectively formed with a pair of check valves, two ends of said main shaft being respectively connected with a diaphragm thereby dividing each of said pump chambers into an air chamber and a liquid chamber, and two end covers being respectively combined at outer sides of said two pump chambers thereby securing said diaphragm between each of said end covers and said pump body, and said two end covers being respectively formed with a first and a second air inlet port and a first and a second main air passage port communicating with said air chambers, and a first and a second switch rod being respectively installed in said first and said second air inlet port;

a pair of check rings, allowing said main shaft to pass, and the interior thereof being formed with a combination part for being correspondingly engaged in said engaging slots located at two sides of said shaft hole, and the bottom periphery of an arc-shaped convex ring formed at the outer side of said check ring being axially extended with a contract ring capable of being contracted and deformed; and a pneumatic control valve, respectively formed with a first and a second air guide pipe and a first and a second air inlet pipe respectively communicating with said first and said second main air passage port and said first and said second air inlet port;

wherein, through the action of said pneumatic control valve, said main shaft being enabled to reciprocally move in said shaft hole, thereby enabling said two diaphragms to be stretched and compressed at the same time for performing a compressing and a sucking stroke to the liquid; when subject to the hydraulic pressure, said arc-shaped convex ring of each of said check rings being deformed, and said contract ring being contracted for enclosing said main shaft thereby forming a liquid checking effect; when each of said check rings not being subject to the hydraulic pressure or the air pressure, said arc-shaped convex ring not being deformed thereby forming a space between said contract ring and said main shaft;

wherein said combination part of said check ring is a plurality of hooks being annularly-arranged and elastic, and said plurality of hooks are buckled in buckle slots formed at an inner side of each of said engaging slots of said shaft hole, said plurality of hooks of each said check ring of said two check rings being located in a corresponding engaging slot of said engaging slots adjacent to said main shaft, said contract ring and said plurality of hooks are located directly between said main shaft and said pump body; said arc-shaped convex ring is located in a middle portion of said check ring between said combination part and said contract ring, said arc-shaped convex ring is spaced apart from said main shaft and engaging said pump body.

2. The pump as claimed in claim 1, wherein said two pump chambers are in communication with said liquid outlet and said liquid inlet passage respectively through a guide port, and each pair of said check valves are correspondingly arranged in parallel in said liquid outlet and said liquid inlet passage.

3. The pump as claimed in claim 1, wherein said check ring and said main shaft are made of polytetrafluoroethylene (PTFE).

4. The pump as claimed in claim 1, wherein said pump body is installed on a base after said pneumatic control valve is installed at the outer side of said pump body.

5. The pump as claimed in claim 1, wherein said two end covers are respectively formed with a plurality of annularly-arranged air outlet ports communicating with said first and said second air inlet port.

* * * * *